US005292406A

United States Patent [19]

Wanngard et al.

[11] Patent Number: 5,292,406

[45] Date of Patent: Mar. 8, 1994

[54] PROCESS FOR ELECTROLYTIC PRODUCTION OF ALKALI METAL CHLORATE AND AUXILIARY CHEMICALS

[75] Inventors: Johan Wanngard, Linjevägen, Sweden; Arne Carlsson, Columbus, Miss.; Jan E. Bäckström, Nödinge, Sweden

[73] Assignee: Eka Nobel AB, Bohus, Sweden

[21] Appl. No.: 831,544

[22] Filed: Feb. 5, 1992

[30] Foreign Application Priority Data

Feb. 5, 1991 [SE] Sweden ..... 9100365-7

[51] Int. Cl.[5] ..... C25B 1/24

[52] U.S. Cl. ..... 204/95; 204/98; 204/128; 423/487; 423/475

[58] Field of Search ..... 204/95, 98, 128, 129; 423/487, 475; 210/670, 167; 55/68; 261/2

[56] References Cited

U.S. PATENT DOCUMENTS 3,897,320 7/1975 Cook, Jr. ..... 204/95

4,795,535 1/1989 Boldue et al. ..... 204/95

FOREIGN PATENT DOCUMENTS 1178239 11/1984 Canada ..... C25B 1/14

*Primary Examiner*—Kathryn Gorgos

*Attorney, Agent, or Firm*—Burns, Doane, Swecker & Mathis

[57] ABSTRACT

The present invention relates to a process to limit the content of impurities in the production of alkali metal chlorate, by integrating the production of chlorate with the production of chlorine and alkali metal hydroxide, which auxiliary chemicals are used in the chlorate process. The alkali metal chlorate is produced by electrolysis of a purified electrolyte containing alkali metal chloride, alkalization of the chlorate electrolyte obtained and precipitation of the chlorate formed by evaporation of the chlorate electrolyte. The very pure water separated in the crystallizer and alkali metal chloride is used in a membrane or diaphragm cell in the production of alkali metal hydroxide, which hydroxide is used in the production of alkali metal chlorate. Either pure chlorine or hydrogen chloride absorbed in water can be used in acidification, at which hydrogen chloride is produced from chlorine and hydrogen generated in the process.

11 Claims, 1 Drawing Sheet

PROCESS FOR ELECTROLYTIC PRODUCTION OF ALKALI METAL CHLORATE AND AUXILIARY CHEMICALS

The invention relates to a process to limit the content of impurities in the production of alkali metal chlorate, at which the production of chlorate is integrated with the production of chlorine and alkali metal hydroxide, which auxiliary chemicals are used in the chlorate process. The alkali metal chlorate is produced by electrolysis of a purified electrolyte containing alkali metal chloride, alkalization of the chlorate electrolyte obtained and precipitation of the chlorate formed by evaporation of the chlorate electrolyte. Suitably, the very pure water separated in the crystallizer is used in a membrane or diaphragm cell in the production of chlorine and alkali metal hydroxide, partly as a raw material directly in the cathode compartment and partly to prepare the chloride electrolyte, together with alkali metal chloride. Where appropriate, the pure water is also used in the production of hydrochloric acid by absorption of hydrogen chloride after a hydrogen chloride burner. The alkali metal hydroxide produced is used in the alkalization of chlorate electrolyte, in the gas scrubbers and in the purification of the technical salt fed. In acidification, either pure chlorine or hydrogen chloride can be used, at which hydrogen chloride is produced from chlorine and hydrogen generated in the process. The amount of alkali metal hydroxide produced in the process, is preferably equivalent to the main consumption in the production of chlorate.

BACKGROUND

Alkali metal chlorate, and particularly sodium chlorate, is an important chemical in the cellulose industry, where it is used as a raw material in the production of chlorine dioxide, which is an important bleaching chemical for cellulose fibers. Alkali metal chlorate is produced by the electrolysis of an electrolyte containing alkali metal chloride according to the overall formula:

$$MeCl + 3\ H_2O \rightarrow MeClO_3 + 3\ H_2 \text{ (me=alkali metal)}$$

The process is cyclic; where in a first step, the chloride electrolyte is brought to an electrolyzer for the formation of hypochlorite, whereupon the solution is brought further to reaction vessels for further reaction to chlorate. Subsequently, chlorate formed is separated by crystallization. The crystallization of chlorate can be brought about by evaporation or cooling. Evaporation means that the water is evaporated and condensed in a separate step, either indirectly in a heat exchanger or, more frequently, directly in the cooling water. Cooling crystallization means that the temperature is lowered to such an extent, that the chlorate electrolyte becomes saturated with chlorate whereby crystals precipitate.

In the cyclic chlorate process, the pH is regulated in several positions within the range 5.5–12, to optimize the process conditions in each unit operation. Thus, a weakly acidic or neutral pH is used in the electrolyzer and reaction vessels to promote the formation of hypochlorite, while the pH in the crystallizer is alkaline to avoid the reaction of hypochlorite to chlorine instead of to chlorate and also to reduce the risk of corrosion.

Normally, hydrogen chloride is used to lower the pH, but also, chlorine is used completely or partly. Normally, alkali metal hydroxide is used to make the solutions alkaline. Hydrogen chloride and alkali metal hydroxide are added as aqueous solutions. Commercially available technical solutions of hydrochloric acid and alkali metal hydroxide contain impurities, which even at low contents are unfavorable for the chlorate electrolysis.

A chloride electrolyte to be electrolyzed in a chlorate cell, must not contain high contents of impurities. Thus, $Ca^{2+}$, $Mg^{2+}$ and $SO_4^{2-}$ cause depositions on the cathodes and thereby a higher operating voltage and energy costs, while heavy metals decompose the hypochlorite formed to chloride and oxygen, instead of, as desired, to chlorate. To avoid these drawbacks, the chloride electrolyte is normally purified, which most simply takes place already in the preparation of brine by dissolution of the technical salt. In this part of the process, the flow is small and chlorine compounds such as molecular chlorine and chlorate have not yet been formed. The impurities may also be removed later in the process before the chloride electrolyte is introduced into the electrolyzers. The purification can be brought about by the addition of chemicals containing $CO_3^{2-}$, $OH^-$ and $Ba^{2+}$ for the precipitation of e.g. calcium carbonate, magnesium hydroxide and barium sulphate and by letting the brine or chloride electrolyte pass ion-exchange resins where additional $Ca^{2+}$, $Mg^{2+}$ and also $Ba^{2+}$ are removed. Suitably, alkali metal hydroxide is used in the purification of brine and the regeneration of ion-exchange resin.

Normally, a chloride electrolyte to be electrolyzed in a chlor-alkali process, must also be purified from impurities. This is especially valid for membrane cells, where magnesium and calcium hydroxide can be precipitated in the membrane and cause increased operating voltage and reduced current yield, if not substantial purification measures are brought about. In this connection, the chloride electrolyte or brine is treated in a similar way as the solution intended for the chlorate electrolysis, i.e. by precipitation with chemicals and separation followed, by ion exchange. Suitably, alkali metal hydroxide is also used here. In this case, the chlorine content in the recirculating chloride electrolyte must be reduced down to the ppm level, since presently available ion-exchange resins in the final purification step are not resistent to free chlorine. In this connection, a vacuum is used in one or more steps, as well as adsorption on active carbon and/or chemical reaction with e.g. hydrogen peroxide.

According to CA 1,178,239, a process for the production of sodium chlorate is combined with a membrane cell for the production of chlor-alkali. In this case, the object is to simultaneously produce sodium hydroxide, chlorine, hydrochloric acid and sodium chlorate, the chemicals needed in the cellulose production. In the chlorate electrolyzer and membrane cell, aqueous chloride electrolyte is electrolyzed, which electrolyte is obtained by the addition of sodium chloride to the depleted chloride electrolyte from the anode compartment of the membrane cell. The concentrated chloride electrolyte is purified in two steps, where the content of $Ca^{2+}$, $Mg^{2+}$ and $SO_4^{2-}$ are reduced in the first step by precipitation. The contents of $Ca^{2+}$, $Mg^{2+}$, $Ba^{2+}$ and the heavy metals are further reduced in a second step, by contacting the solution with an ion-exchange resin. The method for precipitation of chlorate is not evident from the patent. Use of the produced sodium hydroxide in the production of sodium chlorate, is not mentioned either in the patent.

According to U.S. Pat. No. 3,897,320, chlorine and alkali metal hydroxide are produced in a membrane cell by electrolysis of an aqueous alkali metal chloride solution. The chlorine and chlorate-containing anolyte in the membrane cell, is transferred to a chlorate cell for further electrolysis to chlorate, which is precipitated in a crystallizer. The remaining mother liquor is returned to the membrane cell by way of the arrangement for the production of fresh alkali metal chloride solution or directly to the chlorate cell. It is not evident from the patent, if the precipitation of chlorate takes place by cooling or evaporation with direct or indirect condenser. In this combined process, conventionally purified water and alkali metal chloride are used without any special purification step, which makes it necessary to withdraw contaminated products such as chlorate and alkali metal hydroxide, so that the contents of impurities can be controlled. Thus, this process is not useful when the process is closed to a high extent or when pure products are required. The alkali metal hydroxide produced is preferably used in cooking and bleaching of groundwood pulp.

Thus, various methods have been proposed to keep the concentration of impurities in the chlorate process at an acceptable level. Common to these methods is either expensive purification of the raw material or discharge of unwanted substances from the process after that they have been allowed to contaminate the chloride electrolyte and electrolyte of various concentrations. The discharge occurs either by one or more purification steps in the process or by the impurities accompanying the products. To avoid accumulation of impurities in the chlorate electrolysis and with that an accompanying requirement for purification measures, is what this invention aims at solving.

THE INVENTION

The invention relates to a process by which alkali metal chlorate can be produced, whereby a number of purification steps used in conventional processes becomes superfluous. The process comprises electrolysis in a chlorate cell of an electrolyte containing purified alkali metal chloride, alkalization of a portion of the flow of chlorate electrolyte, precipitation of the chlorate formed by evaporation of the alkalized chlorate electrolyte in a crystallizer. After this, the water separated from the chlorate crystals and alkali metal chloride are electrolyzed in cells equipped with membranes or diaphragms for the production of alkali metal hydroxide, which is used in the production of alkali metal chlorate.

Thus, the invention concerns a process for the production of alkali metal chlorate as disclosed in the claims. According to the invention, it relates to an integrated process where the main part of the purification in the process is made by precipitation, ion exchange and evaporation of the technical salt fed and dissolved in water. By utilizing the condensate from the chlorate crystallizer and the alkali metal chloride substantially purified for the production of chlorate, it is possible to produce very pure alkali metal hydroxide and chlorine and hydrogen chloride, respectively. These chemicals can be added to the chlorate process without additional purification, as opposed to the auxiliary chemicals being produced separately from the chlorate process. Especially, the invention concerns the use of the alkali metal hydroxide produced in the alkalization of chlorate electrolyte prior to the crystallization of produced chlorate, in the hydrogen and reactor gas scrubbers and also in the precipitation of impurities and regeneration of ion-exchange resins in connection with dissolution and purification of the technical alkali metal chloride.

The advantage of the present process is, besides the simple purification process, also the large flexibility in regards to the amount of alkali metal hydroxide produced in relation to alkali metal chlorate. In the production of hydrogen chloride, an excess of hydrogen is desirable, which is achieved by using a combination of hydrogen formed in the chlor-alkali process and in the chlorate cells. Furthermore, the hazards of transporting primarily chlorine are reduced, since the auxiliary chemicals are produced in immediate connection to the location of consumption. Also, this means that a chlorine condensation plant is not needed since the gaseous chlorine is immediately consumed.

According to the present process, the alkalized chlorate electrolyte is evaporated, which means that water is removed by evaporation whereby the concentration of chlorate is increased to such an extent that crystals precipitate. The water is recondensed by cooling in a heat exchanger. The water obtained as a condensate in the present process contains very low contents of impurities, e.g. $SO_4^{2-}$, due to the indirect cooling. Furthermore, the amount of water being condensed in the chlorate crystallizer is sufficient for the total requirement of water in the chlor-alkali process. Suitably, all of the water added to the membrane or diaphragm cell for the production of alkali metal hydroxide, is taken from the evaporation of chlorate electrolyte. Preferably, the water separated in the crystallizer is brought to the cathode compartment of the membrane or diaphragm cell and/or to the preparation of electrolyte containing alkali metal chloride, which electrolyte is used to produce alkali metal hydroxide by electrolysis. It is especially preferred to bring the water separated in the crystallizer to the cathode compartment. Suitably, the water separated in the crystallizer is used for all requirements of water in the process, such as for the preparation of electrolyte containing alkali metal chloride which electrolyte is used to produce alkali metal chlorate by electrolysis, for the dilution of alkali metal hydroxide produced, for the production of hydrochloric acid by absorption of hydrogen chloride after an optional hydrogen chloride burner, in the scrubber liquids for purification of hydrogen and reactor gas, for the washing of chlorate crystals, and optionally, also for the dissolution of the technical salt fed for the preparation of alkali metal-containing brine.

In the electrochemical cell for the production of chlorine, alkali metal hydroxide and hydrogen, the anode and cathode compartments are suitably separated by a membrane or diaphragm mainly resistent to chlorine and alkali metal hydroxide, preferably a membrane. Diaphragm relates to gas separating constructions of mainly inorganic material, such as asbestos, but also organic material, such as fluorine-containing polymers, can be included. Membrane relates to ion selective, organic material, such as various plastics and polymers. Suitably, the water to the cathode compartment is added from the indirect condenser of the chlorate crystallizer.

The alkali metal hydroxide produced in the membrane or diaphragm cell, is used for alkalization of the chlorate electrolyte before the crystallizer and also for the precipitation of hydroxides of alkaline earth metals, iron and aluminium and regeneration of ion-exchange resins in the first and second step, respectively, of the purification of fresh brine. The alkali metal hydroxide is also used in the hydrogen and reactor gas scrubbers to remove chlorine in hydrogen from the chlorate cells and in the residual gas from optional hydrogen chloride burners and for purification of process air from the reaction vessels and optional chlorine absorption, respectively. Of the total amount of alkali metal hydroxide, about 50% is used in the scrubbers, 30–40% in electrolyte filtration and the subsequent alkalization and 10–20% in the purification of fresh brine. Alkalization relates to an increase in the pH to a value above about 7. Suitably, the electrolyte in the crystallizer has a pH in the range from about 8.5 to about 11.

The amount of alkali metal hydroxide produced in the membrane or diaphragm cell per ton of alkali metal chlorate produced and recalculated as sodium hydroxide per ton of dry sodium chlorate, can lie in the range from about 10 to about 100 kg, suitably in the range from 15 to 60 kg and preferably in the range from 20 to 50 kg. It is especially preferred that the amount of alkali metal hydroxide produced is essentially equivalent to the amount of hydroxide used in the electrolysis of alkali metal chlorate.

The chlorine produced in the anode compartment of the membrane or diaphragm cell can be used for acidification in the production of alkali metal chlorate. Especially, the electrolyte fed to the chlorate electrolyzers can be provided with chlorine, by absorption in water or directly in electrolyte. However, it is preferred that the chlorine is reacted with the hydrogen formed in the cathode compartment of the membrane or diaphragm cell and/or the chlorate electrolyzers, to hydrogen chloride.

For an efficient process, a certain excess of hydrogen is required. Preferably, said hydrogen can be taken from the chlorate electrolysis. The hydrogen chloride formed is absorbed in water for the production of hydrochloric acid, preferably in water from the condenser of the chlorate crystallizer. The hydrochloric acid produced, is suitably used for acidification in the production of alkali metal chlorate, especially of electrolyte fed to the chlorate electrolyzers. The addition of hydrochloric acid and/or chlorine can be made to any of the flows fed to the preparation of electrolyte for the chlorate electrolysis, e.g. recirculating mother liquor from the chlorate crystallizer and depleted electrolyte from the reaction vessels. Preferably, the addition is made between the heat exchangers for cooling of the electrolyte and the electrolyzers, by absorbing chlorine in a circulating portion of the flow of electrolyte, or by direct addition of hydrochloric acid to the main flow. In this position, the temperature is about 60° to about 70° C., which is suitable for absorption of chlorine and the flow more than sufficient. Furthermore, the residence time in the subsequent electrolyzers means a further absorption potential at the same time as the connection to the reactor scrubbers means an efficient way to take care of the chlorine not absorbed after all. In the electrolyte fed to the electrolyzers, suitably, the pH lies in the range from about 5.0 to about 7.5, preferably in the range from 6.5 to 7.3.

The amount of chlorine produced in the membrane or diaphragm cell is stoichiometrically equivalent to the amount of alkali metal hydroxide produced. Consequently, the amount of chlorine produced per ton of alkali metal chlorate produced recalculated as dry sodium chlorate, can lie in the range from about 8.9 to about 89 kg, suitably in the range from 13 to 54 kg and preferably in the range from 18 to 45 kg. It is especially preferred that the amount of chlorine and hydrogen chloride produced, is essentially equivalent to the amount being used in the production of alkali metal chlorate.

The present process is suitably used in the production of sodium or potassium chlorate, preferably sodium chlorate, but other alkali metal chlorates can also be produced. The chlorate is suitably produced by a continuous process, but a batchwise process is also useful.

When carrying out the process according to the present invention, an alkali metal chloride solution is brought to an electrolyser with monopolar or bipolar cells. In a monopolar cell, the electrodes are connected in parallel, which gives a high current intensity and low voltage drop. In bipolar cells, the anode of one cell is connected to the cathode of the next, i.e. they are connected in series, which gives a low current intensity and high voltage drop. The anode can be a metallic anode comprising a titanium base and a coating of at least one of the metals of the platinum group or an oxide thereof being attached to the base. The cathode can be produced from iron, carbon steel, stainless steel or titanium, or comprising such a metal and a metal of the platinum group.

The yield of the chlorate is reduced and the energy consumption increased, by several reactions competing with the desired formation of chlorate. The most important of these is the cathodic reduction of $ClO^-$ to $Cl^-$, which reduction is counteracted by addition of sodium dichromate. Suitably, the concentration of sodium dichromate lies within the range from 1 to 6 g/liter of electrolyte and preferably within the range from 3 to 5 g/liter of electrolyte.

In the present process, use is made of different temperatures in different steps, to facilitate e.g. the absorption of chlorine, crystallization of alkali metal chlorate and desired electrochemical reactions. Suitably, the temperature in the electrolyte in the chlorate cells is from about 60° to about 90° C., preferably from 60° to 80° C.

BRIEF DESCRIPTION OF THE DRAWING

The invention can best be described with reference to the drawing, wherein FIG. 1 schematically illustrates a chlorate manufacturing plant which includes one embodiment of the invention.

DETAILED DESCRIPTION OF THE PREFERRED EMBODIMENTS

Figure 1:
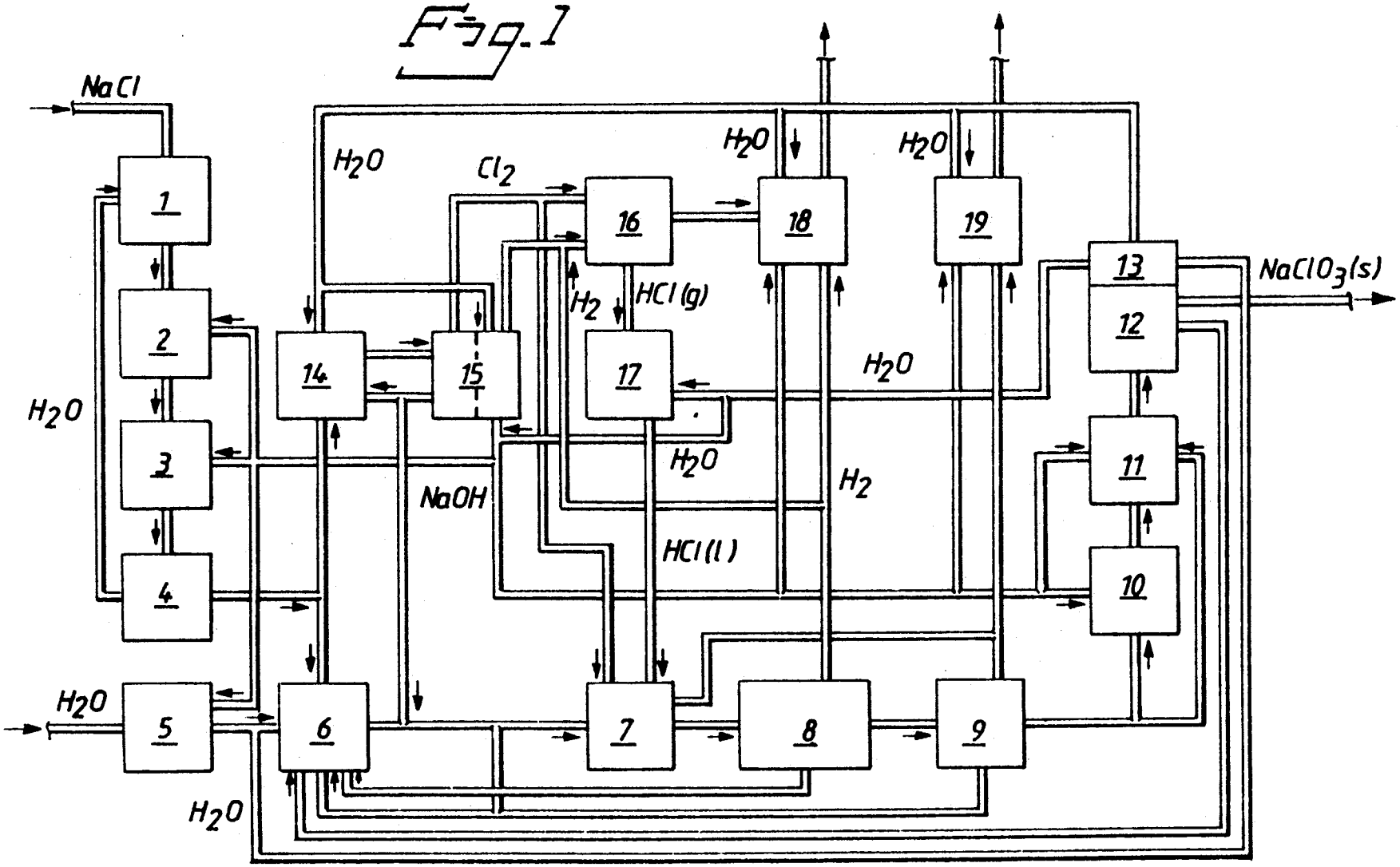

The invention is now being described with reference to FIG. 1, showing a schematic description of a plant to realize the process according to the invention. The process is illustrated for the alkali metal sodium, but the corresponding chemical compounds and concentrations are of course valid also for potassium or other alkali metals. Furthermore, the production of chlorine and sodium hydroxide in a membrane cell is described, but the use of a diaphragm cell is also suitable.

Sodium chloride in the form of technical salt and recirculated water from the salt evaporator is brought to a dissolver (1). The close to saturated brine obtained, with a concentration of from 290 to 310 g of sodium chloride/liter is brought to a purification step (2) for the precipitation of metals such as alkaline earth metals, iron and aluminium, by treatment with sodium hydroxide from the membrane cell and sodium carbonate. After sedimentation of the precipitate, the brine is brought, by way of filtration, to a chelate ion exchanger (3) for further purification. The chelate ion exchanger is regenerated with sodium hydroxide from the membrane cell. Water is evaporated in a salt evaporator (4) and mechanical water separator. Said water is purified and returned to (1). The main part, about 90%, of the thus purified salt slurry is used for the preparation of electrolyte (6) for the production of chlorate, together with chlorate electrolyte from the reaction vessels (9), mother liquor from the chlorate crystallizer (12) and transfer of chlorine-containing and acidic electrolyte from the membrane cells (15). The thus concentrated electrolyte contains from 100 to 140 g of sodium chloride/liter and from 500 to 650 g of sodium chlorate liter, preferably from 110 to 125 g of sodium chloride and from 550 to 580 g of sodium chlorate/liter. The electrolyte is cooled to about 70° C. and pH regulated (7) to within the range from 5.5 to 6.5, whereupon the electrolyte is brought to the chlorate cells (8). The total flow to the chlorate cells is from 75 to 200 $m^3$ of electrolyte per ton of sodium chlorate produced. Each chlorate cell works at a current density of from about 10 to about 45 A/liter of circulating electrolyte. A portion of the chlorate electrolyte is recirculated to (6), while the other part, from about 15 to about 25% , is brought to (9) where the reaction for the formation of chlorate continues. A portion of the flow from the reaction vessels, about 10%, is electrolyte filtered completely or partly and alkalized by introducing a water solution of sodium hydroxide from the membrane cells into a recirculating portion of the flow from the reaction vessels (9). The concentration of sodium hydroxide in the water solution is suitably from 10 to 40 percent by weight, preferably from 25 to 35 percent by weight. The thus alkalized flow is brought to (12), while the rest of the reaction solution depleted in alkali metal chloride is returned to (6) or directly by way of (7) to (8). The crystallizer has an indirect condenser (13), from which condensed water with low contents of impurities is brought to (6), preparation of electrolyte (14) for the production of chlorine and sodium hydroxide, to the cathode compartment of the membrane cell (15) and to the dilution of sodium hydroxide withdrawn from the cathode compartment, absorption of hydrogen chloride (17) and also to the scrubbers for hydrogen (18) and residual gas from the reaction vessels (19). In the crystallizer, the reaction solution is concentrated by evaporation, whereby sodium chlorate crystallizes and is withdrawn by way of a filter. The mother liquor being saturated with respect to chlorate and containing high contents of sodium chloride, is returned to (6). A minor part, about 10%, of the salt/salt slurry purified in (1), (2), (3) and (4), is used for the preparation of electrolyte (14) for the production of chlorine and sodium hydroxide, by dissolution in water or in recirculating electrolyte from/to the membrane cell. The content of sodium chloride in the anolyte withdrawn, has dropped from about 300 to about 200 g of sodium chloride/liter, due to the electrolysis. The thus concentrated electrolyte contains from 250 to 300 g of sodium chloride/liter and from 1 to 4 g of chlorine/liter, preferably from 270 to 300 g of sodium chloride/liter and from 1 to 2 g of chlorine/liter. The sodium hydroxide formed in the cathode compartment of the membrane cell, has after removal from the cell a concentration of from about 10 to about 40 percent by weight, preferably from 25 to 35 percent by weight. A portion of the removed, highly purified sodium hydroxide is diluted with water from the condenser or is brought undiluted to the electrolyte filtration (10), the alkalization step (11), the scrubber system for hydrogen and reactor gas (18 and 19, respectively), the step for precipitation of impurities (2) and also the regeneration of ion-exchange resins for technical alkali metal chloride (3) and process water fed (5). The electrolyte from (11) is evaporated in (12), whereby sodium chlorate crystallizes and the water evaporated is condensed in (13). After dewatering, the dry content of the crystalline sodium chlorate lies within the range from about 0.5 to about 4 percent by weight, preferably within the range from about 1.5 to about 3 percent by weight. The very pure water obtained, is brought to the preparation of electrolyte (14) containing sodium chloride for the production of chlorine and sodium hydroxide, and also to the cathode compartment of the membrane cell (15). The water and sodium hydroxide as well as the electrolyte are so pure, that further purification steps are superfluous.

Suitably, chlorine formed in the anode compartment and hydrogen formed in the cathode compartment, are brought to a hydrogen chloride burner (16) together with hydrogen formed in the chlorate cells, whereby hydrogen chloride formed is absorbed (17) in the water from the condenser of the crystallizer and added to the electrolyte for the production of chlorate immediately before the electrolysers (7). Unreacted chlorine is absorbed in alkaline solution in the hydrogen scrubbers (18), where hydrogen from the chlorate electrolysers is also purified.

It is also quite possible to use chlorine directly, by absorption in a circulating portion of the electrolyte flow for the production of chlorate (7). Chlorine not absorbed, is brought to the reactor gas scrubbers (19), for absorption in alkaline solution before purified process air is vented to the atmosphere.

EXAMPLE

Electrolytical production of 15,000 kg of sodium chlorate/hour in combination with the equivalent amount of sodium hydroxide in a membrane cell, according to the present process. 20 kg of sodium hydroxide/ton of sodium chlorate is required for alkalization, which is equivalent to 300 kg of sodium hydroxide/hour and 266 kg of chlorine/hour, or, if chlorine is burned together with hydrogen to hydrogen chloride, 274 kg of hydrogen chloride/hour. In the example below, hydrogen chloride is used.

Totally, 8,239 kg of sodium chloride/hour is consumed, of which 889 kg/hour is consumed in the membrane cells. Of these, 439 kg/hour is consumed in the production of chlorine and sodium hydroxide and the rest, 450 kg/hour, is transferred to the chlorate cells by way of 20% of the recirculated chlorine-containing anolyte. The content of sodium chloride is 250 g/liter and the flow 1.8 $m^3$/hour.

The total consumption of water is 7,606 kg/hour, divided into 2,489 kg/hour in the membrane cells and 5,117 kg/hour in the chlorate cells. Of the 2,489 kg/hour which is consumed in the membrane cells, 700 kg/hour is part of the 30% strong sodium hydroxide leaving the cells. Furthermore, 1,620 kg $H_2O$/hour leaves the membrane cells by way of the 20% strong share of the anolyte which is added to the chlorate cells and the remaining 135 kg/hour is consumed in the electrolysis. An amount of 605 kg of water/hour is consumed in the absorption of hydrogen chloride.

We claim:

1. A process for the production of alkali metal chlorate by electrolysis, comprising the steps of:

(a) obtaining purified alkali metal chloride by purification of technical grade alkali metal chloride in at least one ion-exchange step;

(b) obtaining an aqueous solution comprising a first portion of the purified alkali metal chloride from step (a) and water, said aqueous solution forming a first alkali metal chloride electrolyte;

(c) electrolyzing the first alkali metal chloride electrolyte from step (b), thereby forming alkali metal chlorate in the electrolyte;

(d) alkalizing a portion of the chlorate in the electrolyte obtained from step (c);

(e) evaporation the water from the alkalized electrolyte from step (d) in a crystallizer, to thereby precipitate alkali metal chlorate and form a mother liquor;

(f) condensing the water evaporated in step (e) in an indirect condenser;

(g) combining a first portion of the condensed water from step (f) and a second portion of the purified alkali metal chloride from step (a) to form a substantially chlorate free second alkali metal chloride electrolyte;

(h) electrolyzing the second alkali metal chloride electrolytic from step (g) to form alkali metal hydroxide;

(i) using at least a portion of the alkali metal hydroxide from step (h) for alkalization in step (d); and (j) using the mother liquor separated in step (e) and a second portion of the condensed water from step (f) for obtaining the aqueous solution in step (b).

2. A process according to claim 1, wherein the electrolysis of step (h) is carried out in a membrane or diaphragm cell.

3. A process according to claim 2, wherein the water is added to the membrane or diaphragm cell, said water being obtained from evaporation of chlorate electrolyte in step (e).

4. A process according to claim 2, wherein the membrane or diaphragm cell produces chlorine, and wherein the chlorine so produced is used for acidification in the production of alkali metal chlorate.

5. A process according to claim 2, wherein the membrane or diaphragm cell produces chlorine and hydrogen and the electrolysis of step (c) produces hydrogen, and wherein the process includes the step of forming hydrogen chloride by reacting chlorine from the membrane or diaphragm cell and hydrogen from one or both the membrane or diaphragm cell, and the electrolysis step (c).

6. A process according to claim 5, wherein the process further includes absorbing the hydrogen chloride in water and using the hydrogen chloride for acidification in the production of alkali metal chlorate.

7. A process according to claim 5, wherein the amount of chlorine and hydrogen chloride produced is substantially equivalent to the amount being used in the production of alkali metal chlorate.

8. A process according to claim 1, wherein the amount of alkali metal hydroxide produced is substantially equivalent to the amount being used for alkalization in step (c).

9. A process according to claim 1, wherein the process further includes the additional steps of hydrogen and reactor gas scrubbing, precipitation of impurities and regeneration of ion exchange resin in connecting with dissolution and purification of technical alkali metal chloride, and wherein the alkali metal hydroxide produced in step (h) is used in said additional steps.

10. A process according to claim 1, wherein the electrolysis of step (h) is carried out in a membrane cell.

11. A process according to claim 1, wherein the electrolysis of step (h) is carried out in a diaphragm cell.

* * * * *